US012516859B2

(12) United States Patent
Talhouarn et al.

(10) Patent No.: US 12,516,859 B2
(45) Date of Patent: Jan. 6, 2026

(54) ACCUMULATOR HEAT EXCHANGER

(71) Applicant: Carrier Corporation, Palm Beach Gardens, FL (US)

(72) Inventors: Fabien Talhouarn, Franqueville Saint Pierre (FR); Maxime Gaultier, Franqueville Saint Pierre (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 201 days.

(21) Appl. No.: 18/365,262

(22) Filed: Aug. 4, 2023

(65) Prior Publication Data

US 2024/0044558 A1 Feb. 8, 2024

(30) Foreign Application Priority Data

Aug. 5, 2022 (EP) ..... 22189140

(51) Int. Cl.
*F25B 43/00* (2006.01)
*F28D 1/047* (2006.01)

(52) U.S. Cl.
CPC ..... *F25B 43/006* (2013.01); *F28D 1/0472* (2013.01); *F25B 2400/051* (2013.01)

(58) Field of Classification Search
CPC .. F25B 43/006; F25B 2400/051; F25B 40/00; F25B 43/00; F25B 41/42; F25B 2500/18; F28D 1/0472; F28D 20/0034; F28D 7/024; F28D 2020/0069; F28D 7/02
See application file for complete search history.

(56) References Cited

U.S. PATENT DOCUMENTS 3,955,375 A 5/1976 Schumacher
4,217,765 A 8/1980 Ecker
4,231,230 A 11/1980 Gratzer
(Continued)

FOREIGN PATENT DOCUMENTS

CN 103673436 B 1/2016
CN 105805990 A 7/2016
(Continued)

OTHER PUBLICATIONS

Extended European Search Report received in European application No. 22189140.1 dated Jan. 18, 2023, 08 Pages.

*Primary Examiner* — Kun Kai Ma
(74) *Attorney, Agent, or Firm* — Drew Folgmann

(57) ABSTRACT

An accumulator heat exchanger comprising: an accumulator vessel with an internal volume; a heat exchange coil disposed within the internal volume of the accumulator vessel wherein the heat exchange coil encloses an axially extending inner volume; a first inlet conduit extending from outside of the accumulator vessel to an inner axial end of the first inlet conduit within the internal volume of the accumulator vessel, and a first outlet conduit extending from within the internal volume of the accumulator vessel to outside of the accumulator vessel; and a second inlet conduit for subcooled refrigerant fluid and a second outlet conduit for subcooled refrigerant fluid. The second inlet conduit and second outlet conduit provide an inlet and outlet flow path for the heat exchange coil. The first inlet conduit comprises a plurality of outlets, each adapted to direct refrigerant fluid towards the heat exchange coil.

20 Claims, 6 Drawing Sheets

(56) References Cited

U.S. PATENT DOCUMENTS

| | | | | | |
|---|---|---|---|---|---|
| 4,488,413 | A * | 12/1984 | Bottum | F28D 7/08 62/503 |
| 5,075,967 | A * | 12/1991 | Bottum | F25B 43/006 62/503 |
| 5,233,842 | A | 8/1993 | Manning | |
| 5,245,833 | A * | 9/1993 | Mei | F25B 43/006 62/503 |
| 6,298,687 | B1 | 10/2001 | Dienhart | |
| 6,463,757 | B1 | 10/2002 | Dickson | |
| 7,918,107 | B2 | 4/2011 | Klotten | |
| 11,058,980 | B2 | 7/2021 | Zapletal | |
| 11,566,823 | B1 * | 1/2023 | Feria | F25B 30/02 |
| 2021/0300149 | A1 | 9/2021 | Zapletal | |
| 2025/0123038 | A1 * | 4/2025 | Tsukiyama | F25B 43/006 |

FOREIGN PATENT DOCUMENTS

| | | | |
|---|---|---|---|
| CN | 110195947 | A | 9/2019 |
| CN | 110195948 | A | 9/2019 |
| DE | 3119440 | A1 | 12/1982 |
| DE | 3127317 | A1 | 1/1983 |
| EP | 1640676 | B1 | 10/2007 |
| EP | 3255361 | B1 | 12/2018 |
| WO | 2018135385 | A1 | 7/2018 |
| WO | 2021242213 | A1 | 12/2021 |

* cited by examiner

ACCUMULATOR HEAT EXCHANGER

CROSS REFERENCE TO RELATED APPLICATIONS

This application claims priority to EP Patent Application No. 22189140.1 filed on Aug. 5, 2022, which is incorporated by reference herein in its entirety.

BACKGROUND

The present disclosure relates to an accumulator heat exchanger and a refrigeration system comprising an accumulator heat exchanger. The present disclosure also relates to a method of heat exchange using an accumulator heat exchanger.

Accumulators are used in refrigeration systems to collect liquid refrigerant and thus prevent liquid refrigerant from passing into the compressor where it can cause damage. Heat exchangers are used in refrigeration systems in order to control the temperature of the refrigerant. It is known to provide accumulator heat exchangers which combine the functions of accumulators and heat exchangers. Accumulator heat exchangers can reduce the temperature of a first refrigerant flow before the refrigerant enters an evaporator in order to increase its cooling capacity, and simultaneously increase the temperature of a second refrigerant flow before the refrigerant enters a compressor in order to promote the formation of gaseous refrigerant from liquid refrigerant. Heat can hence be extracted from the first refrigerant flow to form subcooled refrigerant used within a first portion of the refrigeration system, and that heat can be usefully used for heating the second refrigerant flow to form superheated refrigerant used within a second portion of the refrigeration system.

It is desirable to increase the heat exchange between the two refrigerant flows in order to further improve cooling capacity of the refrigeration system and the overall efficiency of the refrigeration system.

It is known to increase the subcooling of the first refrigerant flow using an additional heat exchanger, such as a liquid vapour heat exchanger or a brazed plate heat exchanger, once the refrigerant exits the accumulator and before entering the evaporator. However, integration of the heat exchanger within the refrigeration system can be complicated and the additional component results in a higher cost and the refrigeration system having a larger volume.

It is therefore also desirable to increase the heat exchange between the two refrigerant flows without increasing the complexity of the refrigeration system and without causing a substantial increase in the space required for the refrigeration system.

BRIEF SUMMARY

According to a first aspect, there is provided an accumulator heat exchanger for use within a refrigeration system, the accumulator heat exchanger comprising: an accumulator vessel with an internal volume for accumulation of refrigerant fluid; a heat exchange coil disposed within the internal volume of the accumulator vessel wherein the heat exchange coil encloses an axially extending inner volume of the heat exchange coil; a first inlet conduit for introducing refrigerant fluid into the internal volume, the first inlet conduit extending from outside of the accumulator vessel to an inner end of the first inlet conduit within the internal volume of the accumulator vessel, and a first outlet conduit for exhausting superheated gaseous refrigerant from the internal volume, the first outlet conduit extending from within the internal volume of the accumulator vessel to outside of the accumulator vessel; and a second inlet conduit for subcooled refrigerant fluid and a second outlet conduit for subcooled refrigerant fluid, wherein the second inlet conduit and second outlet conduit provide an inlet and outlet flow path for the heat exchange coil; wherein the first inlet conduit comprises a plurality of outlets, each of the plurality of outlets adapted to direct refrigerant fluid towards the heat exchange coil.

BRIEF DESCRIPTION OF THE FIGURES

Certain embodiments of the invention will now be described by way of example only and with reference to the accompanying drawings in which.

DETAILED DESCRIPTION

Figure 1:
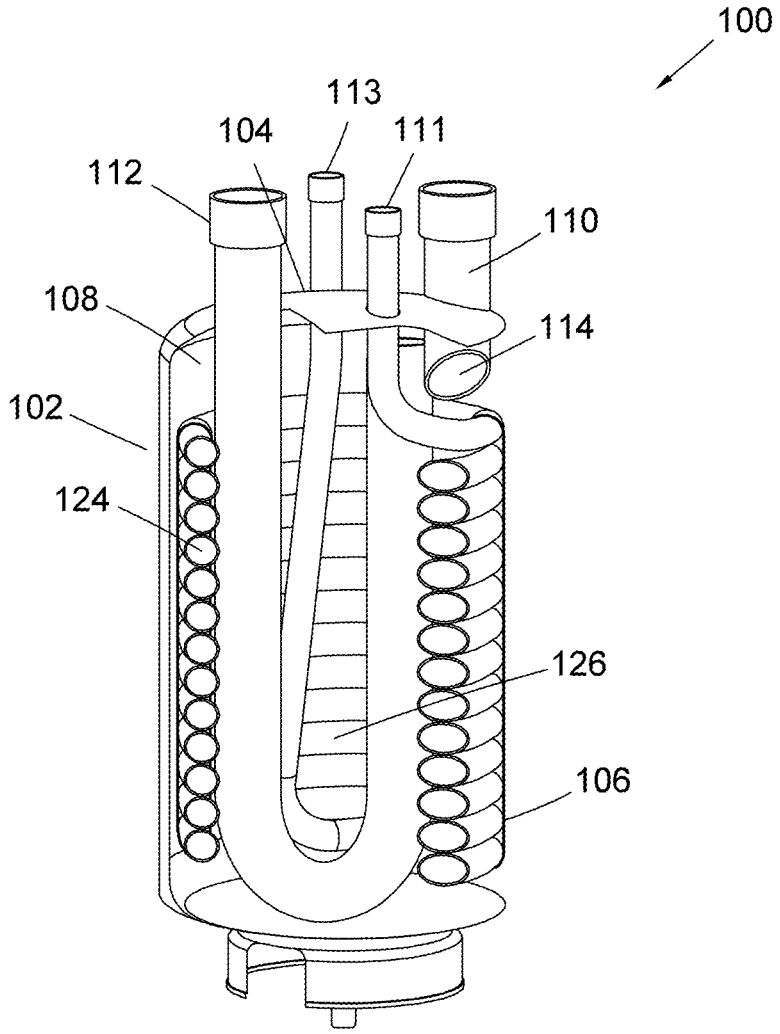
FIG. 1 shows a perspective view of a cross section of an accumulator heat exchanger.

According to a first aspect, there is provided an accumulator heat exchanger for use within a refrigeration system, the accumulator heat exchanger comprising: an accumulator vessel with an internal volume for accumulation of refrigerant fluid; a heat exchange coil disposed within the internal volume of the accumulator vessel wherein the heat exchange coil encloses an axially extending inner volume of the heat exchange coil; a first inlet conduit for introducing refrigerant fluid into the internal volume, the first inlet conduit extending from outside of the accumulator vessel to an inner end of the first inlet conduit within the internal volume of the accumulator vessel, and a first outlet conduit for exhausting superheated gaseous refrigerant from the internal volume, the first outlet conduit extending from within the internal volume of the accumulator vessel to outside of the accumulator vessel; and a second inlet conduit for subcooled refrigerant fluid and a second outlet conduit for subcooled refrigerant fluid, wherein the second inlet conduit and second outlet conduit provide an inlet and outlet flow path for the heat exchange coil; wherein the first inlet conduit comprises a plurality of outlets, each of the plurality of outlets adapted to direct refrigerant fluid towards the heat exchange coil.

It will be appreciated that refrigerant fluid entering the accumulator vessel via the first inlet conduit may comprise gaseous refrigerant, liquid refrigerant or a mixture of these.

The accumulator vessel may have an axial extent and a radial extent. The accumulator vessel may be cylindrical, the axial and radial extent of the accumulator vessel following the axial and radial dimensions of the cylinder respectively.

The heat exchange coil, and the axially extending inner volume defined thereby, may have an axial extent and an extent perpendicular to the axial extent, for example a radial extent. The heat exchange coil and the inner volume defined thereby may therefore comprise an axial direction and a direction perpendicular to the axial direction, for example a radial direction. The axially extending inner volume may be understood as the volume formed at the centre of the coil.

The inner volume may be understood as having a cross section perpendicular to the axis of the heat exchange coil. The cross section may be uniform over the axial extent of the inner volume, or it may vary over the axial extent. The cross section may be circular, e.g. the heat exchange coil may define an inner volume having a circular cross section. To put it another way, the shape of the area enclosed by the coil at a particular axial position may be circular. In other words, the heat exchange coil may have a circular cross section such that the axially extending inner volume has a circular cross section.

The inner volume may be cylindrical, e.g. where the cross section is a circular shape and is uniform over the axial extent.

Other cross-sectional shapes of the inner volume are possible, e.g. the cross section may be oval, square etc. In other words, the heat exchange coil may have an oval cross section such that the axially extending inner volume has an oval cross section. The heat exchange coil may have a square cross section or rectangular cross section such that the axially extending inner volume has a square cross section or rectangular cross section. The inner volume may thereby be a cuboid, e.g. where the cross section is a square/rectangular shape and is uniform over the axial extent.

The heat exchange coil may be a helical coil. It may be a helical coil with a circular cross section, such that the axially extending inner volume has a circular cross section. Where the cross section is circular and uniform over the axial length then the axially extending inner volume is a cylindrical volume formed at the centre of the coil.

The heat exchange coil may be a serpentine heat exchange coil.

The heat exchange coil may comprise an inner surface, i.e. a surface of the coil facing the inner volume of the coil. In other words, the inner surface of the coil comprises the portions of the coil that face inwards, towards the inner volume. This may be a radially inner surface.

Conversely, the heat exchange coil may be understood as comprising an outer surface, i.e. a surface the coil facing away from the inner volume of the coil. In other words, the outer surface of the coil comprises the portions of the coil that face outwards, towards the outside of the coil. This may be a radially outer surface.

It will be understood that the inner surface is closer to a central axis of the coil than the outer surface.

It will be well appreciated that the axially extending inner volume defined by the heat exchange coil is distinct from the internal volume of the pipe forming the coil which comprises the helical refrigerant flow path, i.e. through which the subcooled refrigerant flows.

The first inlet conduit may extend within the inner volume of the heat exchange coil. The outlets of the first inlet conduit may only be in a portion of the first inlet conduit that extends within the inner volume of the heat exchange coil. The first inlet conduit may be comprised of multiple portions or segments interconnected together.

The first inlet conduit may be termed a distributor, or it may comprise a portion known as a distributor. The outlets may be in the distributor portion. The distributor portion may be a separate segment connected to another segment of the first inlet conduit or it may be integral therewith.

The first inlet conduit is adapted to direct gaseous refrigerant towards the heat exchange coil, in other words the first inlet conduit may cause the refrigerant fluid to leave the first inlet conduit in a direction such that the refrigerant fluid approaches the heat exchange coil. The direction of the fluid leaving the first inlet conduit and entering the internal volume of the accumulator vessel may therefore be different to the direction of a refrigerant fluid path which enables gaseous refrigerant to enter the first outlet conduit and then leave the accumulator. The first inlet conduit may be shaped such that that the refrigerant fluid leaving the first inlet conduit approaches the heat exchange coil.

As discussed above, the heat exchange coil may comprise an inner (e.g. radially inner) surface. Each outlet may be adapted to direct refrigerant fluid towards the inner (e.g. radially inner) surface of the heat exchange coil.

The first inlet conduit may comprise a portion that extends into the axially extending inner volume enclosed by the heat exchange coil. The heat exchange coil may then comprise an inner surface (e.g. as discussed above) that faces the first inlet conduit. The first inlet conduit may be adapted to provide a component to the direction of the flow of the refrigerant fluid leaving the first inlet conduit which is in a direction perpendicular to the axial extent of the heat exchange coil. The refrigerant fluid may therefore be directed towards the inner surface of the heat exchange coil. Optionally, the first inlet conduit may be adapted to cause the refrigerant fluid leaving the first inlet conduit to flow in a direction substantially perpendicular to the axial extent of the heat exchange coil. Optionally, the first inlet conduit may be adapted to cause the refrigerant fluid leaving the first inlet conduit to flow in a direction substantially perpendicular to a length or axial extent of the first inlet conduit.

The outlets, or openings, allow the refrigerant to exit the first inlet conduit. The refrigerant fluid is thereby influenced by the shape and/or positioning of the outlets, and it is this influence that causes the refrigerant to flow towards the heat exchange coil. The outlets may be provided via an appendage or additional component added to the first inlet conduit which affects the direction of the refrigerant fluid in order to provide that the refrigerant fluid leaving the first inlet conduit approaches the heat exchange coil. For example, the appendage may comprise spouts or piping.

The plurality of outlets may comprise between 2 and 100 outlets, or may comprise between 4 and 60 outlets, or may comprise between 8 and 40 outlets, or may comprise between 16 and 32 outlets.

The first inlet conduit may be substantially cylindrical or comprise a substantially cylindrical portion. The first inlet conduit may be tubular, for example it may comprise a tube. The first inlet conduit may be termed a distributor tube.

The closer the refrigerant fluid within the internal volume of the accumulator vessel gets to the heat exchange coil, the greater the heat exchange rate between the refrigerant fluid within the internal volume of the accumulator vessel and the subcooled refrigerant in the heat exchange coil.

Similarly, the greater the mixing of the refrigerant within the internal volume of the accumulator vessel, the greater the heat exchange between the refrigerant fluid within the internal volume of the accumulator vessel and the subcooled refrigerant in the heat exchange coil. Thus, by causing the refrigerant leaving the first inlet conduit to flow in a direction other than the route to the first outlet conduit, and by causing the refrigerant to impact on the heat exchange coil, greater turbulence is created within the accumulator vessel and so greater mixing of the refrigerant within the internal volume of the accumulator vessel will occur. A larger volume of refrigerant will then flow close to the heat exchange coil so that greater heat exchange occurs.

An inlet of the first outlet conduit may be located within the accumulator vessel such that refrigerant leaving the first inlet conduit is not directed towards the inlet of the first outlet conduit. Thus, the inlet of the first outlet conduit may be misaligned vertically or horizontally or both from the position at which the refrigerant leaves the first inlet conduit. By locating the inlet of the first outlet conduit away from the first inlet conduit such that there is no direct path for refrigerant to flow between the two without impacting on a surface of the heat exchange coil, a surface of the accumulator vessel, or being forced along a path with changes in direction, direct sucking of the refrigerant out of the accumulator vessel before significant heat exchange can occur is avoided.

Greater turbulence where the refrigerant fluid meets the heat exchange coil will also reduce the boundary layer in the fluid flowing past the heat exchange coil. This also acts to increase heat transfer between the refrigerant in the internal volume of the accumulator vessel and the heat exchange coil.

Thus, by directing the refrigerant fluid leaving the first inlet conduit towards the heat exchange coil from multiple outlets, heat exchange is significantly increased, e.g. the heat exchange coefficient is increased. The temperature of the superheated refrigerant within the internal volume of the accumulator vessel can be increased by a greater amount. The temperature of the subcooled refrigerant within the heat exchange coil can be reduced by a greater amount (i.e. subcooling is increased). The efficiency of the accumulator heat exchanger can thus be increased. As a result, the cooling capacity of the accumulator heat exchanger can be increased compared to the prior art. Advantageously, the increased cooling capacity of the accumulator heat exchanger is increased without increasing the dimensions of the accumulator exchanger, and without substantially increasing the complexity of the system. The integrated accumulator heat exchanger provided according to the present disclosure is less expensive than providing an accumulator and separate heat exchanger, and is less complex and more efficient to integrate into a refrigeration system than an accumulator and separate heat exchanger.

Optionally, the first inlet conduit may be adapted to cause the refrigerant fluid to leave the first inlet conduit at a higher velocity than the velocity at which the refrigerant fluid entered the first inlet conduit. The increased velocity will assist in the refrigerant fluid approaching the heat exchange coil and the mixing of and turbulence within the refrigerant within the internal volume of the accumulator vessel. Thus, heat exchange between the refrigerant in the internal volume of the accumulator vessel and the refrigerant within the heat exchange coil will be increased.

The first inlet conduit may extend axially within the inner volume of the heat exchange coil. The first inlet conduit may be closed at its inner end, this may be an inner axial end. By being closed at its inner end, the refrigerant fluid is forced to exit through the outlets in the first inlet conduit. This creates a high velocity jet towards the heat exchange coil.

The first inlet conduit may comprise a circumferentially and axially extending surface. The plurality of outlets may be provided in the circumferentially and axially extending surface. The outlets may comprise holes provided in the circumferentially and axially extending surface.

The first inlet conduit may extend parallel to the axial direction of the axially extending inner volume of the heat exchange coil, or may extend in a direction having a component parallel to the axial direction of the axially extending inner volume of the heat exchange coil. A central axis of the first inlet conduit may be coincident with a central axis of the inner volume of the heat exchange coil, or it may be offset therefrom.

Similar to the first inlet conduit, the first outlet conduit may comprise a circumferentially and axially extending surface. The first outlet conduit may comprise a substantially cylindrical portion. Similar to the first inlet conduit, the first outlet conduit may also extend axially within the inner volume of the heat exchange coil. The first inlet and first outlet conduits may extend at least partly parallel to each other within the inner volume of the heat exchange coil.

The first inlet conduit may be closed at its inner axial end so that refrigerant is prevented from leaving the first inlet conduit in an axial direction relative to the heat exchange coil. The inner axial end may be the final portion of the first inlet conduit, the final portion being at the greatest distance tracked by the flow of the refrigerant within the inlet conduit from the portion of the first inlet conduit where the refrigerant first enters the accumulator vessel. The inner axial end of the inlet conduit may be closed via a radially and circumferentially extending surface, or the inner axial end may be shaped in any other way such that there is no opening that would allow refrigerant to leave the first inlet conduit in a direction parallel to the axial direction of the inner volume of the heat exchange coil.

The plurality of outlets may be provided in the form of a plurality of holes where there is material missing from the axially and circumferentially extending surface of the first inlet conduit. The holes may be of any shape, for example they may be circular, square, hexagonal or any other shape. The holes may be the same shape, or the holes may be of differing shapes.

At least some of the holes may be circumferentially distributed around the circumferentially and axially extending surface of the first inlet conduit.

The position of the plurality of holes may be distributed around the circumferentially and axially extending surface of the first inlet conduit so that refrigerant is directed towards the heat exchange coil at multiple angular positions.

The plurality of holes may be equally spaced around the circumference of the circumferentially and axially extending surface of the inlet conduit so that the angular distance between each hole is consistent. For example, in the case where there are four holes the holes may be separated by an angular rotation of 90 degrees, and for the case where there are 5 holes the holes may be separated by an angular rotation of 72 degrees.

At least some of the holes may be axially distributed along the circumferentially and axially extending surface of the first inlet conduit.

The position of the plurality of holes may be distributed over the circumferentially and axially extending surface of the first inlet conduit so that refrigerant is directed towards the heat exchange coil at multiple axial heights.

The plurality of holes may be equally spaced along the axial length of the circumferentially and axially extending surface of the inlet conduit so that the axial distance between each is hole is consistent.

Typically, a plurality of holes may be distributed both circumferentially around and axially along the circumferentially and axially extending surface of the inlet conduit. This maximises the distribution of refrigerant over the heat exchange coil and thus maximises heat exchange.

Where there is both a plurality of holes circumferentially distributed around the circumferentially and axially extending surface of the inlet conduit and a plurality of holes axially distributed along the inlet conduit, the circumferential/angular separation between each hole may be consistent within a set of those plurality of holes. For example, there may be four holes at a single axial height and they may each be separated by 90 degrees around the circumference of the first inlet pipe, there may be a further four holes at a separate height and each of these four holes may be separated by 90 degrees around the circumference of the first inlet conduit. There may be an equal axial distance between holes provided at the same angular position. In some examples there may be a set of holes which are spaced at equal angular separations around the circumference of the first inlet pipe, but some or all of the holes may be axially offset from the other holes within that set.

The holes may have a diameter in the range of 1 to 10 mm, optionally the holes have a diameter in the range of 2 to 8 mm, optionally the holes have a diameter of 5 mm. The holes may have differing diameters, e.g. some may have a diameter in one of these ranges, and others may have a diameter in other(s) of the ranges.

The holes may be sized in order to control the velocity of the refrigerant fluid leaving the first inlet conduit. The holes may be small in order to increase the velocity of the refrigerant fluid. However, the holes must not be so small that functioning of the accumulator heat exchanger is impaired by the pressure required for refrigerant to flow through the holes of the first inlet pipe being too great. In the case in which there is more than one hole, the holes may be of equal size, or the holes may be of differing size. The holes may be circular and their diameter may be in the range of 1 to 10 mm, optionally the one or more holes have a diameter in the range of 2 to 8 mm, optionally the one or more holes have a diameter of 5 mm. Similarly, the holes may be square and their width may be in the range of 1 to 10 mm, in the range of 2 to 8 mm, or may be 5 mm. The holes may be any other shape and their principal or longest length may be in the range of 1 to 10 mm, in the range of 2 to 8 mm, or may be 5 mm.

One or more of the plurality of outlets in the first inlet conduit may comprise a nozzle. In other words a nozzle may be provided at one or more of the outlets in the first inlet conduit.

A nozzle may be provided at each of the outlets in the first inlet conduit. In examples where the outlets are holes, a nozzle may be provided at one or more or each of the holes within the circumferentially and axially extending surface of the first inlet conduit.

The nozzle(s) may be an additional component or additional material positioned at the outlets in order to act as a spout for controlling a jet of refrigerant fluid exiting the first inlet conduit through the outlet. The nozzle(s) may therefore be capable of determining or controlling the direction and/or the velocity of the jet.

The heat exchange coil may for example be a circular helical coil. The heat exchange coil may comprise a pitch. The pitch of the heat exchange coil may be constant or may vary along the axial length of the coil. The pitch may be such that either: i) adjacent windings are not in contact, ii) adjacent windings are in contact, or iii) the pitch varies along the length of the heat exchange coil such that a first portion of adjacent windings are in contact and a second portion of adjacent windings are not in contact.

The pitch of the heat exchange coil may be such that adjacent windings are not in contact. Adjacent windings of the heat exchange coil may not be in contact with another but may be in close proximity in order to provide a small flow path for refrigerant to pass between the windings. Gaps between adjacent windings may be sized so that significant turbulence is induced within the refrigerant as it passes therethrough.

Where there is no contact, or only a small space, between adjacent windings, turbulence will be induced within the refrigerant as it flows past the windings and through the axially and circumferentially extending surface of the coil. This increased turbulence will increase the heat exchange between the refrigerant and the heat exchange coil. Furthermore, by allowing flow between windings, the flow will contact a greater heat exchange surface of the coil thus increasing heat exchange.

The pitch of the heat exchange coil may be such that adjacent windings are in contact. Adjacent windings of the heat exchange coil may be in contact with one another so that there is no flow path available for refrigerant to pass between the windings.

Where there is contact between adjacent windings of the heat exchange coil, there is no route for any meaningful flow of refrigerant within the accumulator vessel to pass through the axially and circumferentially extending surface of the coil. Therefore, by providing the coil with regions of contact between adjacent windings, when in use the volume of refrigerant passing from within the inner volume of the coil to outside of the inner volume of the heat exchange coil by passing through the an axially extending surface of the helical coil is reduced. In some embodiments, adjacent windings are in sufficient, sustained contact such that there is no route for refrigerant to pass from within the inner volume of the coil to outside of the inner volume of the heat exchange coil without first exiting the inner volume of the heat exchange coil at an axial end of the coil. In some implementations the adjacent windings are sealed together in order to fully prevent flow between adjacent windings.

The pitch of the heat exchange coil may vary along the length of the heat exchange coil such that a first portion of adjacent windings are in contact and a second portion of adjacent windings are not in contact. The extent of contact between adjacent windings of the heat exchange coil may vary along the length of the heat exchange coil. The first portion of adjacent windings may comprise a plurality of sections of windings of the heat exchange coil separated by a plurality of sections of windings of the heat exchange coil which form the second portion of adjacent windings.

The first inlet conduit may be coincident with a longitudinal axis of the heat exchange coil.

Thus, the first inlet conduit may extend through the inner volume of the heat exchange coil along the centre line of the heat exchange coil. Where the heat exchange coil is positioned centrally within the accumulator vessel, i.e. the longitudinal axis of the heat exchange coil is aligned with a central axis of the accumulator vessel, the first inlet conduit may therefore also extend along the central axis of the accumulator vessel.

According to a second aspect, a refrigeration system is provided. The refrigeration system comprises the accumulator heat exchanger according to the first aspect and optionally including any other features as described above, a compressor, an evaporator, an expansion valve, and a condenser, wherein the first inlet conduit and the first outlet conduit are positioned between the evaporator and the compressor such that a first refrigerant flow path extends sequentially from the evaporator to the first inlet conduit, to the first outlet conduit and to the compressor, and the second inlet conduit and second outlet conduit are positioned between the condenser and the expansion valve such that a second refrigerant flow path extends sequentially from the condenser to the second inlet conduit, to the second outlet conduit and to the expansion valve.

In some embodiments, the first refrigerant flow path may extend directly from the evaporator to the first inlet conduit and/or directly from the first outlet conduit to the compressor, that is, without passing through another component in between, besides the connecting refrigerant lines or pipes. In other embodiments, the first refrigerant flow path may extend through additional components in between the evaporator and the first inlet conduit, and/or additional components between the first outlet conduit and the compressor, but will maintain the sequence recited above with respect to the evaporator, first inlet conduit, first outlet conduit and compressor.

In some embodiments, the second refrigerant flow path may extend directly from the condenser to the second inlet conduit and/or directly from the second outlet conduit to the expansion valve, that is, without passing through another component in between, besides the connecting refrigerant lines or pipes. In other embodiments, the second refrigerant flow path may extend through additional components in between the condenser and the second inlet conduit, and/or additional components between the second outlet conduit and the expansion valve, but will maintain the sequence recited above with respect to the condenser, second inlet conduit, second outlet conduit and expansion valve.

The first inlet conduit may be directly connected to the evaporator.

A flow path is therefore provided between the evaporator and the first inlet conduit, and besides the connecting refrigerant lines or pipes, this flow path does not extend through any additional component in between the evaporator and first inlet conduit.

The first outlet conduit may be directly connected to the compressor.

A flow path is therefore provided between the first outlet conduit and the compressor, and besides the connecting refrigerant lines or pipes, this flow path does not extend through any additional component in between the first outlet conduit and the compressor.

The refrigeration system may be suitable for use in a transportation application. For example, the refrigeration system may be suitable for use in a refrigerated vehicle and/or trailer. Such refrigerated vehicles and trailers are commonly used to transport perishable goods in a cold chain distribution system. The refrigeration system may be mounted to the vehicle or to the trailer in operative association with a cargo space within the vehicle or trailer for maintaining a controlled temperature environment within the cargo space.

The refrigeration system may be suitable for use in HVAC systems or air conditioning systems which can be installed in buildings, vehicles, or the like.

The refrigeration system may comprise a plurality of evaporators.

The first inlet conduit may receive refrigerant fluid from each of the plurality of evaporators. The temperature of the refrigerant fluid received from each of the evaporators may differ. In other words, the refrigeration system may be a multi-temperature system.

The plurality of evaporators may be provided within the refrigeration system connected in parallel.

The accumulator heat exchanger according to the first aspect and optionally including any other features as described above provides particular advantages in refrigeration systems comprising multiple evaporators. Due to the improved heat exchange with the described accumulator heat exchanger, the single accumulator heat exchanger can be used rather than providing a separate external heat exchanger per evaporator. This is less expensive that utilising a separate external heat exchanger for each evaporator. Moreover, due to a decrease in the number of components, and a decrease in the number of joints required within the refrigerant flow path, there is a reduced leakage of refrigerant.

According to another aspect, there is provided a method of heat exchange using an accumulator heat exchanger according to the first aspect and optionally including any other features as described above. The method comprises: supplying refrigerant fluid into the first inlet conduit; and distributing refrigerant fluid towards the heat exchange coil through the plurality of outlets.

The first inlet conduit thereby introduces refrigerant fluid into the internal volume of the accumulator vessel. The second inlet conduit introduces subcooled refrigerant into the heat exchange coil within the accumulator vessel.

A mixture of gaseous refrigerant and liquid refrigerant may enter the accumulator vessel through the first inlet conduit. Liquid refrigerant may accumulate in a pool within the accumulator vessel and may be periodically vaporized from the accumulator vessel. Gaseous refrigerant may accumulate throughout the vessel, and may generally flow from the first inlet conduit to the inlet of the first outlet conduit.

The refrigerant will exit the first inlet conduit and be directed towards the heat exchange coil. Distributing refrigerant fluid towards the heat exchange coil through the plurality of outlets may comprise providing refrigerant fluid through a plurality of holes within a circumferentially and axially extending surface of the first inlet conduit.

The gaseous refrigerant will become superheated gaseous refrigerant as it travels through the accumulator vessel due to heat exchange with subcooled refrigerant in the heat exchange coil. Superheated refrigerant is at a temperature greater than the dew vapor point of the refrigerant. Subcooled refrigerant is at a temperature lower than the bubble (liquid) point of the refrigerant.

The gaseous refrigerant within the first inlet conduit, the accumulator vessel and the first outlet conduit is at a lower pressure than the refrigerant within the second inlet conduit, heat exchange coil and the second outlet conduit. As a result, the dew vapour point of the refrigerant within the first inlet conduit, the accumulator vessel and the first outlet conduit will be lower than that of the refrigerant within the second inlet conduit, heat exchange coil and the second outlet conduit. Consequently, the gaseous refrigerant can be at a lower temperature than the subcooled liquid refrigerant. Heat exchange therefore takes place via heat transfer from the subcooled liquid refrigerant within the heat exchange coil to the refrigerant fluid within the internal volume of the accumulator vessel. The accumulator heat exchanger therefore acts to further cool the subcooled refrigerant and to further heat the refrigerant fluid within the internal volume of the accumulator vessel to form a superheated gaseous refrigerant. As a result, evaporation of the refrigerant fluid supplied via the first inlet conduit is promoted and the volume of liquid refrigerant accumulation in the accumulator is reduced. The subcooled refrigerant leaving the accumulator heat exchanger also has a greater cooling capacity as a result of its decreased temperature.

The accumulator heat exchanger in this method of heat exchange may be part of a refrigeration system, wherein the refrigeration system comprises; a compressor, an evaporator, an expansion valve, and a condenser, and the method of heat exchange comprises; supplying refrigerant from the evaporator to the first inlet conduit, supplying superheated gaseous refrigerant from the first outlet conduit to the compressor, supplying subcooled liquid refrigerant from the condenser to the second inlet conduit, and supplying subcooled liquid refrigerant from the second outlet conduit to the expansion valve.

In some embodiments, the refrigerant fluid may be supplied directly from the evaporator to the first inlet conduit and/or the superheated gaseous refrigerant may be supplied directly from the first outlet conduit to the compressor, that is, without passing through another component in between. In other embodiments, the refrigerant may flow through additional components in between the evaporator and the first inlet conduit, and/or additional components between the first outlet conduit and the compressor, but will maintain the sequence recited above with respect to the evaporator, first inlet conduit, first outlet conduit and compressor.

In some embodiments, subcooled refrigerant may be supplied directly from the condenser to the second inlet conduit and/or may be supplied directly from the second outlet conduit to the expansion valve, that is, without passing through another component in between. In other embodiments, subcooled refrigerant may flow through additional components in between the condenser and the second inlet conduit, and/or additional components between the second outlet conduit and the expansion valve, but will maintain the sequence recited above with respect to the condenser, second inlet conduit, second outlet conduit and expansion valve.

Refrigerant fluid may be supplied to the first inlet conduit directly from the evaporator. Refrigerant fluid is thereby supplied to the accumulator vessel from the evaporator without the gaseous refrigerant entering an additional component between the evaporator and the first inlet conduit. A combination of gaseous refrigerant and liquid refrigerant may be provided to the accumulator vessel from the evaporator through the first inlet conduit.

Superheated gaseous refrigerant may be supplied directly from the first outlet conduit to the compressor. Superheated gaseous refrigerant is therefore provided to the compressor from the accumulator vessel without passing through an additional component of the refrigeration system between the first outlet conduit and the compressor. Any liquid refrigerant introduced into the accumulator vessel will pool within the vessel and will not flow through the first outlet conduit to the compressor.

As seen in FIG. 1, an accumulator heat exchanger 100 comprises an accumulator vessel 102 having an internal volume 108 for accumulation of refrigerant. The accumulator vessel 102 of FIG. 1 is broadly cylindrical having an axial extent and a radial extent. A cap 104 at an axial end of the accumulator vessel provides a slightly domed end to the accumulator vessel 102. A first inlet conduit 110 and a second inlet conduit 111 extend from outside of the accumulator vessel 102 to inside of the accumulator vessel 102. That is, the first inlet conduit 110 and the second inlet conduit 111 extend into the internal volume 108 of the accumulator vessel 100. A first outlet conduit 112 and a second outlet conduit 113 extend from inside of the accumulator vessel 102 to outside of the accumulator vessel 102.

As seen in FIG. 1, a heat exchange coil 124 is provided within the accumulator vessel 102. The heat exchange coil 124 is in the form of a helical coil with a circular cross-section such that it encloses a cylindrical axially extending inner volume 126.

The second inlet conduit 111 and the second outlet conduit 113 are connected to the heat exchange coil 124 so that the second inlet conduit 111 and the second outlet conduit 113 provide an inlet and outlet flow path for the heat exchange coil 124. In use, subcooled refrigerant flows from the second inlet conduit 111, through the heat exchange coil 124, and to the second outlet conduit 113. In the example shown, the second inlet conduit 111 introduces subcooled refrigerant to an upper axial end of the heat exchange coil 124. In other examples, the second inlet conduit 111 introduces subcooled refrigerant to a lower axial end of the heat exchange coil 124.

In use, refrigerant is delivered to the internal volume 108 of the accumulator vessel 102 by the first inlet conduit 110. Liquid refrigerant will pool within the accumulator vessel 102, whereas gaseous refrigerant will flow to the first outlet conduit 112 to be removed from the accumulator vessel 102.

In this system, gaseous refrigerant exits the first inlet conduit 110 via an opening at the axial end 114 of the first inlet conduit 110 and will thus flow down towards the base of the accumulator vessel 102.

Figure 2:
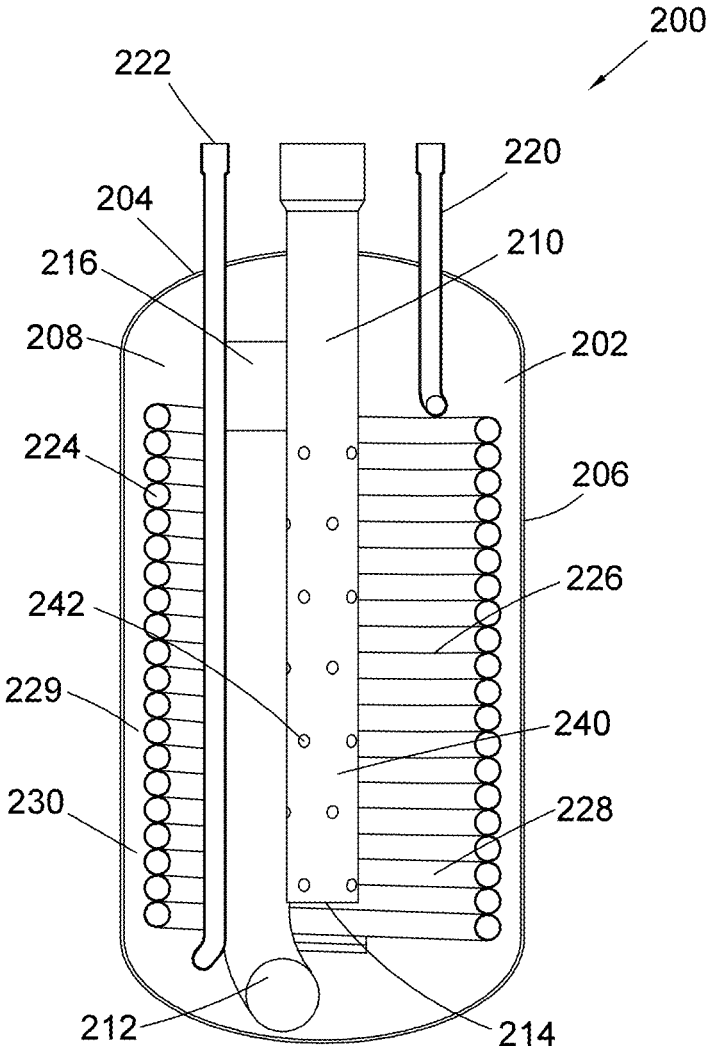
FIG. 2 shows a perspective view of a cross section of an accumulator heat exchanger according to an embodiment of the present invention.

FIG. 2 shows a cross section of an example heat exchanger accumulator 200 according to an embodiment of the present invention. The accumulator heat exchanger 200 comprises an accumulator vessel 202 having an internal volume 208 for accumulation of refrigerant. The accumulator vessel 202 of FIG. 2 is broadly cylindrical having an axial extent and a radial extent. A cap 204 at an axial end of the accumulator vessel provides a slightly domed end to the accumulator vessel 202. A first inlet conduit 210 (also termed a distributor tube) and a second inlet conduit 220 extend from outside of the accumulator vessel 202 to inside of the accumulator vessel 202. That is, the first and second inlet conduits 210, 220 extend into the internal volume 208 of the accumulator vessel 200. A first outlet conduit 212 and a second outlet conduit 222 extend from inside of the accumulator vessel 202 to outside of the accumulator vessel 202. Seals are provided where the first and second inlet conduits 210, 220 and the first and second outlet conduits 212, 222 pass through the cap 204.

As seen in FIG. 2, a heat exchange coil 224 is provided within the accumulator vessel 202. The heat exchange coil 224 is in the form of a helical coil with a circular cross-section such that it encloses a cylindrical axially extending inner volume 226. The second inlet conduit 220 and the second outlet conduit 222 are connected to the heat exchange coil 224 so that the second inlet conduit 220 and the second outlet conduit 222 provide an inlet and outlet flow path for the heat exchange coil 224. In use, subcooled refrigerant flows from the second inlet conduit 220, through the heat exchange coil 224, and to the second outlet conduit 222. In the example shown, the second inlet conduit 220 introduces subcooled refrigerant to an upper axial end of the heat exchange coil 224. In other examples, the second inlet conduit 220 introduces subcooled refrigerant to a lower axial end of the heat exchange coil 224.

Liquid refrigerant will pool within the accumulator vessel 202, whereas gaseous refrigerant will flow to the first outlet conduit 212 to be removed from the accumulator vessel 202.

The first inlet conduit 210 extends from outside of the accumulator vessel 202, through a cap 204 of the accumulator vessel 202 and to an inner axial end 214 of the first inlet conduit 210. The axial end 214 of the first inlet conduit is disposed within the inner volume 226 of the heat exchange coil 224. In use, refrigerant is therefore delivered to the inner volume 226 of the heat exchange coil 224 by the first inlet conduit 210. The first inlet conduit 210 is adapted so that in use refrigerant fluid ejected from the first inlet conduit 210 is directed towards the heat exchange coil 224.

The heat exchange coil comprises an inner surface 228, which is a radially inner surface. The first inlet conduit 210 is disposed within the inner volume 226 of the heat exchange coil 224 such that a circumferentially and axially extending surface 240 of the first inlet conduit faces the radially inner surface 228 of the heat exchange coil. In use, refrigerant fluid is directed towards the radially inner surface 228 of the heat exchange coil 224.

The first inlet conduit 210 comprises outlets within the circumferentially and axially extending surface 240. The outlets comprise holes 242 in the circumferentially and axially extending surface 240. A plurality of holes 242 are distributed over the circumferentially and axially extending surface 240.

The heat exchange coil 224 is disposed within the accumulator vessel 202 so as to provide an axially extending outer gap 230 between the inner surface 206 of the accumulator vessel 202 and a radially outer surface 229 of the heat exchange coil 224. The outer gap 230 is annular in shape due to the cylindrical form of the accumulator vessel 202 and the heat exchange coil 224.

In use, gaseous refrigerant within the internal volume 208 of the accumulator vessel 202 will flow from the base of the accumulator vessel, through the annular gap 230 and to an inlet 216 of the first outlet conduit 212.

Figure 3:
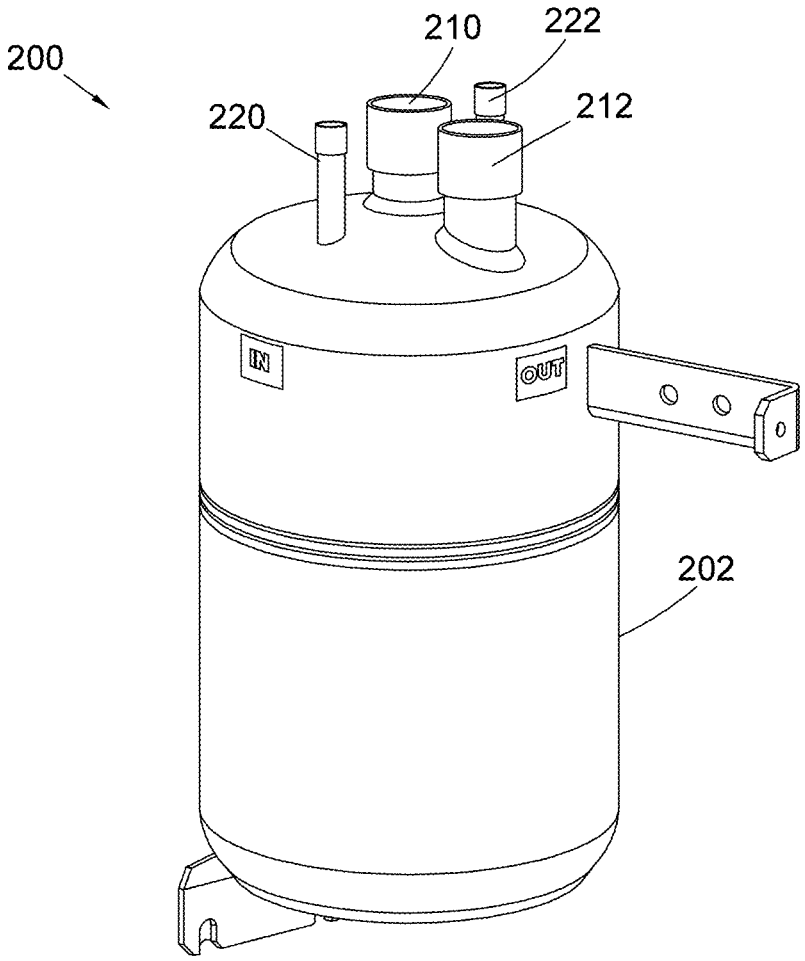
FIG. 3 shows a perspective external view of the accumulator heat exchanger of FIG. 2.

FIG. 3 shows a perspective external view of the accumulator heat exchanger 200. The first and second inlet conduits 210, 220 can be seen entering the accumulator vessel 202. The first and second outlet conduits 212, 222 can be seen exiting the accumulator vessel 202. It will be appreciated that the first outlet conduit 212 comprises a U turn within the internal volume 208 of the accumulator vessel 202 in order to exit the accumulator vessel 202 at the same axial end as the first inlet conduit 210 enters the accumulator vessel 202.

Figure 4:
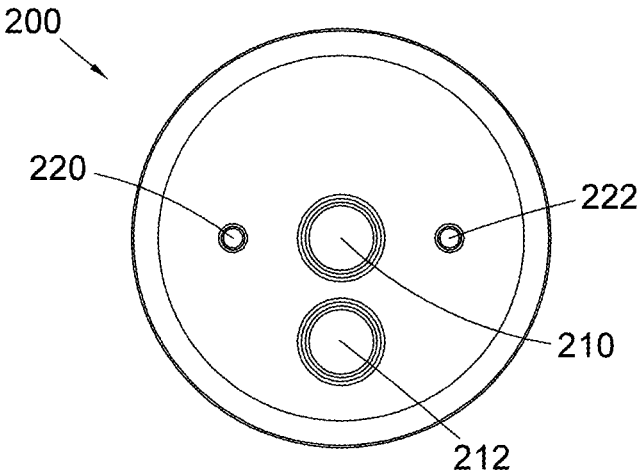
FIG. 4 shows a plan view of the accumulator heat exchanger of FIG. 2.

FIG. 4 shows a plan external view of the accumulator heat exchanger 200. The first inlet conduit is shown to be coincident with the central axis of the accumulator vessel 202.

Figure 5C:
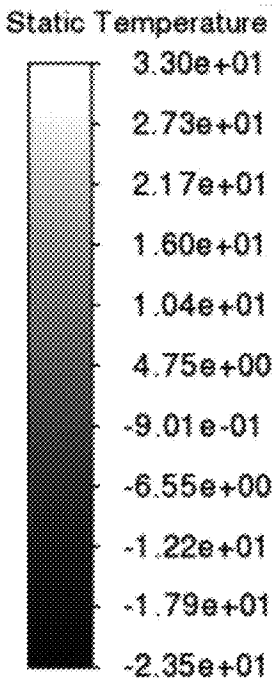
FIG. 5*c* shows the scale used in FIGS. 5*a* and 5*b* to represent the temperature of the accumulator heat exchangers.
Figure 5B:
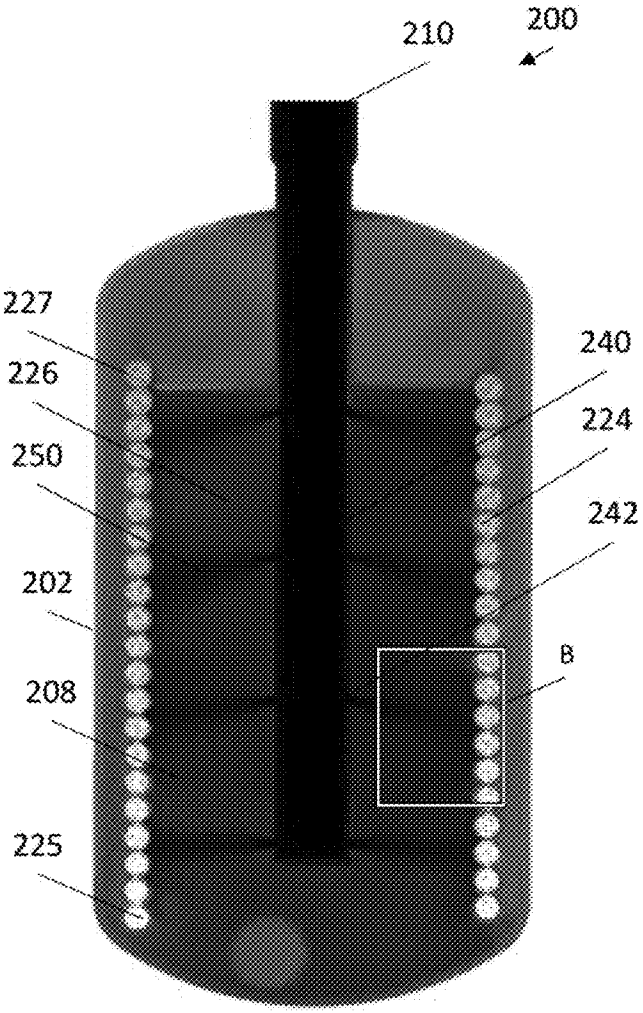
FIG. 5*b* shows a heat map of a planar slice of the accumulator heat exchanger of FIG. 2.
Figure 5A:
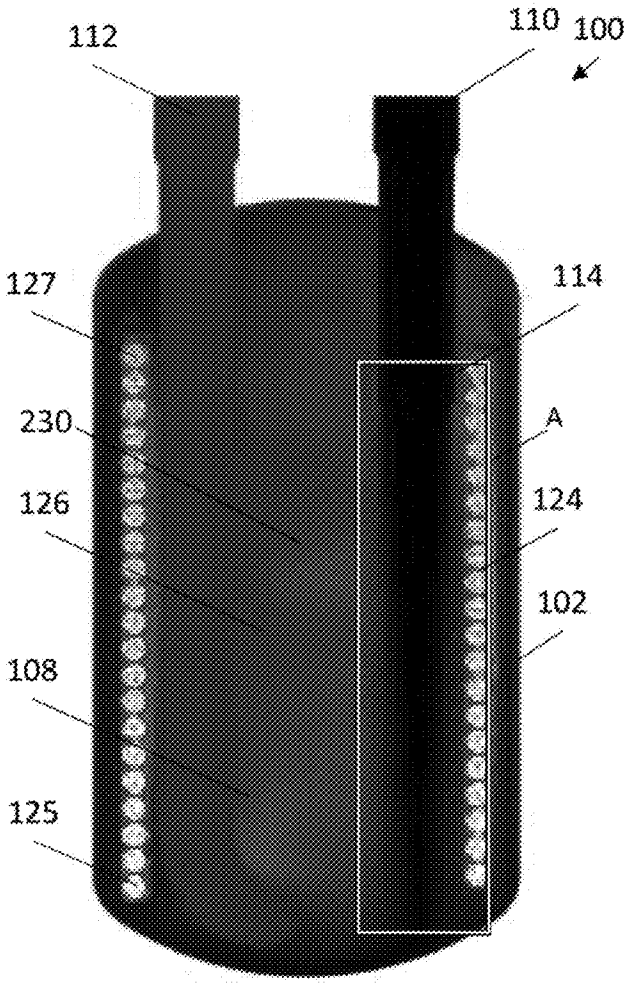
FIG. 5*a* shows a heat map of a planar slice of the accumulator heat exchanger of FIG. 1.

FIG. 5*a* shows a heat map of a planar slice of the accumulator heat exchanger 100 of FIG. 1, the planar slice comprising the central axes of the accumulator heat exchanger 100. The accumulator heat exchanger 100 comprises a first inlet conduit 110 which does not have the capability to direct refrigerant fluid towards the heat exchange coil 124. It can be seen from the temperature data displayed in the heat map that relatively cool refrigerant flows from the outlet 114 of the first inlet conduit 110 towards the base of the internal volume 108 of the accumulator vessel 102. As can be seen within box A of FIG. 5*a*, the refrigerant flowing from the outlet 114 of the first inlet conduit 110 passes the heat exchange coil 124 without substantial interaction with the coil and without substantial heat transfer between the refrigerant within the internal volume of the accumulator vessel and the refrigerant within the heat exchange coil 124. The first outlet conduit 112 is shown in FIG. 5*a*, however the first outlet conduit 212 of the accumulator heat exchanger 200 is offset from the plane illustrated in FIG. 5*a* and so is not shown.

FIG. 5*b* shows a heat map of a planar slice of an accumulator heat exchanger 200 as described above, the planar slice comprising the central axes of the accumulator heat exchanger 200. Refrigerant fluid is introduced into the internal volume 208 of the accumulator vessel 202 via the first inlet conduit (distribution tube) 210. The first inlet conduit 210 comprises holes 242 on a circumferentially and axially extending surface 240 which direct the refrigerant fluid towards the heat exchange coil 224. Jets 250 of cold refrigerant can be seen emanating from the holes 242 in the first inlet conduit 210 approaching the heat exchange coil 224. As can be seen in box B, the refrigerant entrained in the jets interacts with and is deflected by the heat exchange coil 224.

The scale used to denote temperature, shown in FIG. 5*c*, is the same scale used in both FIG. 5*a* and FIG. 5*b*. When comparing the temperature of the refrigerant within the internal volume 108, 208 of the accumulator vessels 102 and 202 and outside of the inner volume of the heat exchange coil 126, 226, it can be seen that the temperature is higher in the accumulator vessel 202 shown in FIG. 5*b* compared to the temperature within the accumulator vessel 102 shown in FIG. 5*a*. In other words, the refrigerant from the first inlet conduit 210 present in the internal volume 208 of the accumulator vessel 202 and outside of the inner volume of the heat exchange coil 226 is at a higher temperature due to more efficient heat exchange with the refrigerant in the heat exchange coil 224.

FIG. 5*a* shows that, in this example accumulator heat exchanger, the temperature of the refrigerant within the heat exchange coil 124 reduces by around 11 degrees C. as it rises from the base of the heat exchange coil 125 to the top of the heat exchange coil 127 within the accumulator heat exchanger 100 shown in FIG. 5*a*.

FIG. 5*b* shows that, in this particular embodiment, the temperature of the refrigerant within the heat exchange coil 224 reduces by around 15 degrees C. as it rises from the base of the heat exchange coil 225 to the top of the heat exchange coil 227. The temperature of the refrigerant rising from the base of the heat exchange coil 225 to the top of the heat exchange coil 227 therefore decreases to a greater extent in the accumulator heat exchanger 200 when compared to the accumulator heat exchanger 100. In other words, refrigerant in the heat exchange coil 224 has been cooled to a greater extent by more efficient heat exchange with the refrigerant from the first inlet conduit 210. In this example, an improvement of 4 degrees C. of cooling has been achieved by the heat exchange coil 224, which is an improvement of about 37% in relation to the 11 degrees C. of cooling by the heat exchange coil 125.

In general, use of an accumulator heat exchanger comprising a first inlet conduit with a plurality of outlets, each of the plurality of outlets adapted to direct refrigerant fluid towards the heat exchange coil, can result in improvements to the subcooling of refrigerant within the heat exchange coil of around 37% compared to the heat exchanger accumulator 100 of FIG. 1.

Figure 6:
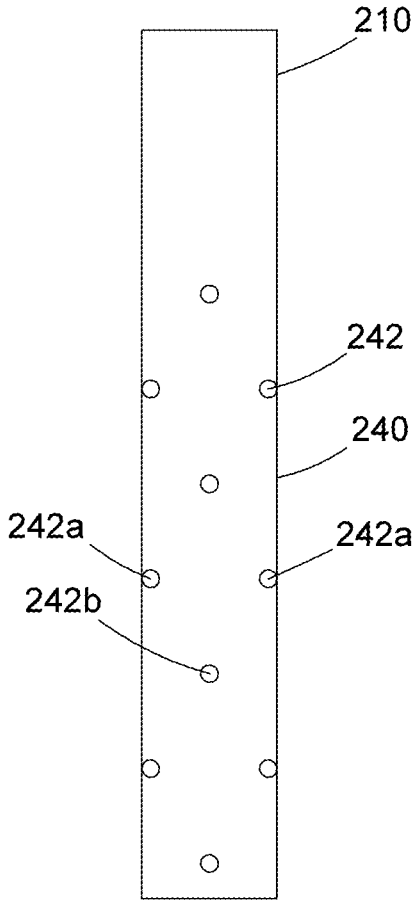
FIG. 6 shows a schematic view of a first inlet conduit provided within the accumulator heat exchanger of FIG. 2.

FIG. 6 shows a schematic of the first inlet conduit 210. The first inlet conduit comprises a circumferentially and axially extending surface 240. Holes 242 are provided in the circumferentially and axially extending surface 240 of the first inlet conduit 210.

In the example shown, the holes 242 are provided such that there is equal axial distance between those holes that are provided at the same angular rotation around the first inlet conduit 210. In the example shown, the holes 242 are distributed such that there is a 90 degree separation between holes 242 disposed at the same axial height. Four holes are provided at the same axial height. Holes 242*a* disposed at the same axial height are circumferentially offset by 45 degrees to the holes 242*b* disposed in an axially adjacent layer. The skilled person will appreciate that the distribution of the holes may be readily altered compared to the example shown in FIG. 6.

Additional parts may be added within the accumulator vessel to enhance the heat exchange between the refrigerant in the accumulator vessel and the refrigerant in the heat exchange coil. Heat exchange can be increased, for example, by causing the refrigerant within the accumulator vessel to flow along a longer flow path after exiting the first inlet conduit and before entering the first outlet conduit. For example, a separator plate may be disposed across the heat exchange coil, e.g. at the top of the coil, e.g. outside of the inner volume of the heat exchange coil and in contact with a top axial end of the heat exchange coil, such that the outlets of the first inlet conduit are disposed on a first side of the separator plate and the inlet of the first outlet conduit is disposed on a second side of the separator plate opposite the first side. Such a separator plate may therefore force refrigerant to flow downwards within the internal volume of the heat exchange coil and then flow upwards in a gap, e.g. gap 230 between the inner surface 206 of the accumulator vessel 202 and a radially outer surface 229 of the heat exchange coil 224 to an inlet 216 of the first outlet conduit 212.

Figure 7:
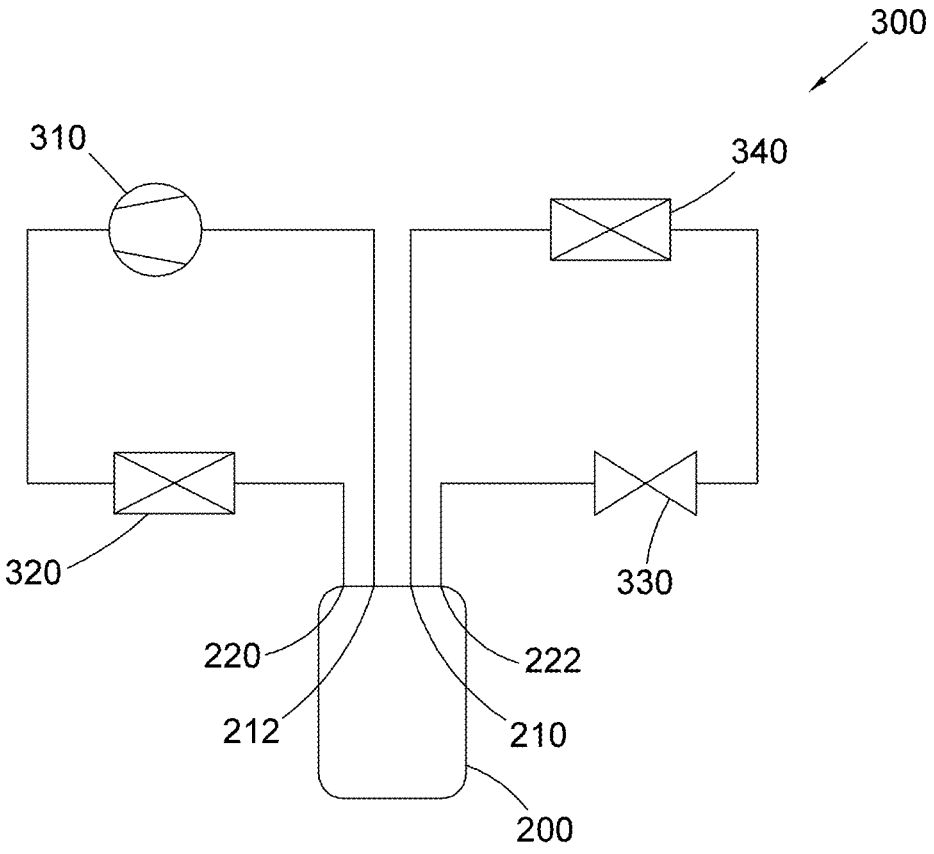
FIG. 7 shows a schematic view of a refrigeration system including the accumulator heat exchanger of FIG. 2.

FIG. 7 shows a schematic of a refrigeration system 300 comprising the accumulator heat exchanger 200 described above. The refrigeration system 300 includes a compressor 310, a condenser 320, an expansion valve 330 and an evaporator 340. The condenser 320 is connected to the second inlet conduit 220 of the accumulator 200. The expansion valve 330 is connected to the second outlet conduit 212 of the accumulator 200.

Refrigerant flows sequentially from the compressor 310, to the condenser 320, to the heat exchange coil 224 within the accumulator heat exchanger 200, to the expansion valve 330, to the evaporator 340, to the first inlet and first outlet conduits 210, 212 of the accumulator heat exchanger 200 and back to the compressor 310.

The refrigerant that exits the condenser will be at a relatively high pressure (compared to the refrigerant exiting the evaporator 340) and will be a liquid. The condenser 320 causes heat rejection from the refrigerant to the surroundings by cooling the refrigerant to its saturation temperature at which point the gaseous refrigerant condenses to a liquid. The latent heat evolved during the condensation is transferred to the surroundings. The condenser 320 may have a sufficient cooling capacity to reduce the temperature of the liquid to below the saturation temperature thereby producing subcooled refrigerant. The high pressure within the condenser 320 means that the saturation temperature of the refrigerant is greater than the saturation temperature of the refrigerant in the evaporator 340, which is at a lower pressure. The refrigerant temperature of the subcooled liquid refrigerant can hence be greater than the temperature of the gaseous refrigerant supplied by the evaporator 340. Heat is therefore transferred from the subcooled refrigerant in the heat exchange coil 224 to the gaseous refrigerant within the first inlet conduit 210, the accumulator internal volume 208 and the first outlet conduit 212.

The increased subcooling of the refrigerant exiting the second outlet conduit 222 in turn increases the cooling capacity of the refrigerant such that once it is supplied to the evaporator 340, an increased amount of heat is taken from the surroundings as the liquid evaporates to a gas. As a result, the efficiency of the refrigeration system is increased.

Increasing the heat of the refrigerant supplied to the accumulator vessel 202 via the first inlet conduit 210 will reduce the proportion of that refrigerant in the liquid phase within the accumulator vessel 202. As a result, less liquid refrigerant accumulates in the accumulator and a greater amount of gaseous refrigerant is available to continue through the refrigeration system.

Use of the accumulator heat exchanger 200 described above within this refrigeration system 300 allows for these benefits to be achieved whilst avoiding increasing the complexity of the refrigeration system 300 and without increasing the space required for the refrigeration system 300. The refrigeration system 300 and its use is therefore suited to applications such as transport refrigeration where the refrigeration system 300 can be mounted to a vehicle or trailer in operative association with a cargo space within the vehicle or trailer for maintaining a controlled temperature environment within the cargo space.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

The invention claimed is:

1. An accumulator heat exchanger for use within a refrigeration system, the accumulator heat exchanger comprising:

an accumulator vessel with an internal volume for accumulation of refrigerant fluid;

a heat exchange coil disposed within the internal volume of the accumulator vessel, wherein the heat exchange coil encloses an axially extending inner volume of the heat exchange coil;

a first inlet conduit for introducing the refrigerant fluid into the internal volume, the first inlet conduit extending from outside of the accumulator vessel to an inner end of the first inlet conduit within the internal volume of the accumulator vessel, and a first outlet conduit for exhausting superheated gaseous refrigerant from the internal volume, the first outlet conduit extending from within the internal volume of the accumulator vessel to outside of the accumulator vessel; and a second inlet conduit for subcooled refrigerant fluid and a second outlet conduit for the subcooled refrigerant fluid, wherein the second inlet conduit and the second outlet conduit provide an inlet and outlet flow path for the heat exchange coil, wherein the first inlet conduit comprises a plurality of outlets, each of the plurality of outlets adapted to direct the refrigerant fluid towards the axially extending inner volume of the heat exchange coil.

2. The accumulator heat exchanger of claim 1, wherein the heat exchange coil comprises an inner surface, and each outlet is adapted to direct the refrigerant fluid towards the inner surface of the heat exchange coil.

3. The accumulator heat exchanger of claim 1, wherein the first inlet conduit extends axially within the inner volume of the heat exchange coil.

4. The accumulator heat exchanger of claim 1, wherein the first inlet conduit is closed at its inner end.

5. The accumulator heat exchanger of claim 1, wherein
the first inlet conduit comprises a circumferentially and axially extending surface; and
the plurality of outlets comprises a plurality of holes provided in the circumferentially and axially extending surface.

6. The accumulator heat exchanger of claim 5, wherein at least some of the plurality of holes are circumferentially distributed around the circumferentially and axially extending surface of the first inlet conduit.

7. The accumulator heat exchanger of claim 5, wherein at least some of the plurality of holes are axially distributed along the circumferentially and axially extending surface of the first inlet conduit.

8. The accumulator heat exchanger of claim 5, wherein each hole of the plurality of holes has a diameter in the range of 1 to 10 mm.

9. The accumulator heat exchanger of claim 1, wherein one or more of the plurality of outlets in the first inlet conduit comprise a nozzle.

10. The accumulator heat exchanger of claim 1, wherein the first inlet conduit is coincident with a longitudinal axis of the heat exchange coil.

11. A refrigeration system comprising:
the accumulator heat exchanger of claim 1,
a compressor,
an evaporator,
an expansion valve, and
a condenser, wherein
the first inlet conduit and the first outlet conduit are positioned between the evaporator and the compressor such that a first refrigerant flow path extends sequentially from the evaporator to the first inlet conduit, to the first outlet conduit and to the compressor, and
the second inlet conduit and the second outlet conduit are positioned between the condenser and the expansion valve such that a second refrigerant flow path extends sequentially from the condenser to the second inlet conduit, to the second outlet conduit and to the expansion valve.

12. The refrigeration system of claim 11, wherein the first inlet conduit is directly connected to the evaporator.

13. The refrigeration system of claim 11, wherein the first outlet conduit is directly connected to the compressor.

14. A method of heat exchange using the accumulator heat exchanger of claim 1, the method comprising:
supplying the refrigerant fluid into the first inlet conduit; and
distributing the refrigerant fluid towards the heat exchange coil through the plurality of outlets.

15. The method of claim 14, wherein distributing the refrigerant fluid towards the heat exchange coil through the plurality of outlets comprises providing the refrigerant fluid through a plurality of holes within a circumferentially and axially extending surface of the first inlet conduit.

16. The accumulator heat exchanger of claim 8, wherein each hole of the plurality of holes has a diameter in the range of 2 to 8 mm.

17. The accumulator heat exchanger of claim 1, wherein each of the plurality of outlets are adapted to direct refrigerant fluid directly towards the axially extending inner volume of the heat exchange coil.

18. The accumulator heat exchanger of claim 1, wherein the refrigerant fluid leaving the first inlet conduit is directed perpendicular to an axial extent of the heat exchange coil.

19. The accumulator heat exchanger of claim 1, wherein the heat exchange coil comprises a pitch, and wherein the pitch varies along an axial length of the heat exchange coil.

20. The accumulator heat exchanger of claim 1, wherein the first inlet conduit is adapted to increase a velocity of the refrigerant fluid exiting the plurality of outlets relative to a velocity at which the refrigerant fluid enters the first inlet conduit.

* * * * *